US008948657B2

(12) United States Patent
Toyonori et al.

(10) Patent No.: US 8,948,657 B2
(45) Date of Patent: Feb. 3, 2015

(54) CHARGING DEVICE AND IMAGE FORMING APPARATUS

(71) Applicant: Canon Kabushiki Kaisha, Tokyo (JP)

(72) Inventors: Masatsugu Toyonori, Yokohama (JP); Ryota Matsumoto, Yokohama (JP); Yuki Narumi, Hiratsuka (JP); Koichi Hashimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/075,109

(22) Filed: Nov. 8, 2013

(65) Prior Publication Data

US 2014/0064790 A1 Mar. 6, 2014

Related U.S. Application Data

(63) Continuation of application No. PCT/JP2013/067209, filed on Jun. 24, 2013.

(30) Foreign Application Priority Data

Jul. 2, 2012 (JP) ..... 2012-148963

(51) Int. Cl.
*G03G 15/02* (2006.01)

(52) U.S. Cl.
CPC ..... *G03G 15/0216* (2013.01); *G03G 15/0233* (2013.01)
USPC ..... 399/175; 399/176

(58) Field of Classification Search
USPC ..... 399/175, 176, 174; 361/221
See application file for complete search history.

(56) References Cited

U.S. PATENT DOCUMENTS

| | | | | |
|---|---|---|---|---|
| 8,620,186 | B2 * | 12/2013 | Yoshida et al. | 399/176 |
| 2005/0241092 | A1 * | 11/2005 | Takesawa et al. | 15/179 |
| 2010/0008699 | A1 * | 1/2010 | Kobashi et al. | 399/129 |
| 2012/0033984 | A1 * | 2/2012 | Ikeda | 399/50 |

FOREIGN PATENT DOCUMENTS

| | | | |
|---|---|---|---|
| JP | 5-204227 | A | 8/1993 |
| JP | 8-137197 | A | 5/1996 |
| JP | 10-026914 | A | 1/1998 |
| JP | 2001-075334 | A | 3/2001 |
| JP | 2001-117320 | A | 4/2001 |
| JP | 2012-008398 | A | 1/2012 |

* cited by examiner

*Primary Examiner* — Sophia S Chen
(74) *Attorney, Agent, or Firm* — Canon USA Inc IP Division

(57) ABSTRACT

To provide a charging device and an image forming apparatus that can restrict generation of a winding-seam irregularity of a roll brush for a long period. A charging device 2 is configured so that, when first and second charging members 21*a* and 21*b* perform charging processing on a rotating photosensitive member 3, a region 40*a* on a surface of the photosensitive member 3 facing a winding seam 35*a*, which is a seam of a base cloth 31 serving as a base material of the first charging member 21*a*, is not superposed on a region 40*b* on the surface of the photosensitive member 3 facing a winding seam 35*b*, which is a seam of a base cloth 31 serving as a base material of the second charging member 21*b*.

5 Claims, 12 Drawing Sheets

(a)

(b)

(a)

(b)

CHARGING DEVICE AND IMAGE FORMING APPARATUS

CROSS-REFERENCE TO RELATED APPLICATIONS

This application is a Continuation of International Patent Application No. PCT/JP2013/067209, filed Jun. 24, 2013, which claims the benefit of Japanese Patent Application No. 2012-148963, filed Jul. 2, 2012, both of which are hereby incorporated by reference herein in their entirety.

TECHNICAL FIELD

The present invention relates to a charging device used in an image forming apparatus using an electrophotographic technology, and also relates to the image forming apparatus.

BACKGROUND ART

A charging method for an electrophotographic photosensitive member (photosensitive member) in an electrophotographic image forming apparatus may be a brush charging method. This charging method includes an electrically discharging method that uses an electric discharge generated between a charging brush serving as a charging member and a photosensitive member, and an injection charging method that electrically charges a photosensitive member by directly applying current from a charging brush to the photosensitive member.

A roll charging brush (hereinafter, also referred to as "roll brush") used in the brush charging method may be fabricated by helically winding a base cloth, which is a strip-like base material having conductive fibers implanted, around a cylindrical metal core bar without a gap. If such a roll brush is used, a charge irregularity (hereinafter, also referred to as "winding-seam irregularity" of the photosensitive member may be generated because of a winding gap generated near a winding seam, which is a seam formed by mutually adjacent edges of the strip-like base cloth with respect to the core bar. Consequently, a density irregularity may be generated in an image. In particular, with the injection charging method, since the photosensitive member is electrically charged by directly applying current from the fibers, if a winding gap is generated, this part may not sufficiently electrically charge the photosensitive member. Hence, with the injection charging method, the density irregularity generated in an image may be increased as compared with the electrically discharging method.

As one of countermeasures for the winding-seam irregularity, there is suggested inclined-fiber processing in which tip ends of fibers of a roll brush are inclined and hence a gap is filled (see PTL 1).

CITATION LIST

Patent Literature

PTL 1 Japanese Patent Laid-Open No. 5-204227

However, even if the inclined-fiber processing as described in PTL 1 is provided, as the roll brush is used for a long period, a bundle of fibers may be split from the part of the winding gap, and the inclined-fiber processing may be collapsed. Hence, it is difficult to restrict the winding-seam irregularity for a long period.

Therefore, an object of the present invention is to provide a charging device and an image forming apparatus that can restrict generation of a winding-seam irregularity of a roll brush for a long period.

SUMMARY OF INVENTION

The object is attained by a charging device and an image forming apparatus according to the invention. In concrete, a first invention is a charging device configured to electrically charge a rotatable photosensitive member. The charging device includes a first charging member formed by winding a base material, which is provided with conductive fibers in a brush-like form, around an outer peripheral surface of a core material, the first charging member being rotatable while the conductive fibers contact the photosensitive member; a second charging member formed by winding a base material, which is provided with conductive fibers in a brush-like form, around an outer peripheral surface of a core material, the second charging member being rotatable while the conductive fibers contact the photosensitive member, at a position located downstream of the first charging member in a rotation direction of the photosensitive member; and a driving mechanism configured to rotationally drive the first charging member and the second charging member so that, when the first charging member and the second charging member electrically charge the rotating photosensitive member, a region on a surface of the photosensitive member facing a seam, which is formed by mutually adjacent edges of the base material of the first charging member at a contact part between the first charging member and the photosensitive member, is not superposed on a region on the surface of the photosensitive member facing a seam, which is formed by mutually adjacent edges of the base material of the second charging member at a contact part between the second charging member and the photosensitive member.

A second invention is an image forming apparatus including a rotatable photosensitive member; a charging device including a first charging member formed by winding a base material, which is provided with conductive fibers in a brush-like form, around an outer peripheral surface of a core material, the first charging member being rotatable while the conductive fibers contact the photosensitive member, and a second charging member formed by winding a base material, which is provided with conductive fibers in a brush-like form, around an outer peripheral surface of a core material, the second charging member being rotatable while the conductive fibers contact the photosensitive member, at a position located downstream of the first charging member in a rotation direction of the photosensitive member, the charging device electrically charging the photosensitive member; a power supply configured to apply a voltage to the charging device; an exposure device configured to cause the surface of the photosensitive member electrically charged by the first charging member and the second charging member and to form an electrostatic latent image; a developing device configured to develop the electrostatic latent image formed on the surface of the photosensitive member, by using a toner; and a driving mechanism configured to rotationally drive the first charging member and the second charging member so that, when the first charging member and the second charging member electrically charge the rotating photosensitive member, a region on the surface of the photosensitive member facing a seam, which is formed by mutually adjacent edges of the base material of the first charging member at a contact part between the first charging member and the photosensitive member, is not superposed on a region on the surface of the photosensitive member facing a seam, which is formed by mutually adjacent edges of the base material of the second charging member at a contact part between the second charging member and the photosensitive member.

Further features of the present invention will become apparent from the following description of exemplary embodiments with reference to the attached drawings.

DESCRIPTION OF EMBODIMENTS

A charging device and an image forming apparatus according to the present invention are described in further detail below with reference to the drawings.

First Embodiment

1. General Configuration and Operation of Image Forming Apparatus

Figure 1:
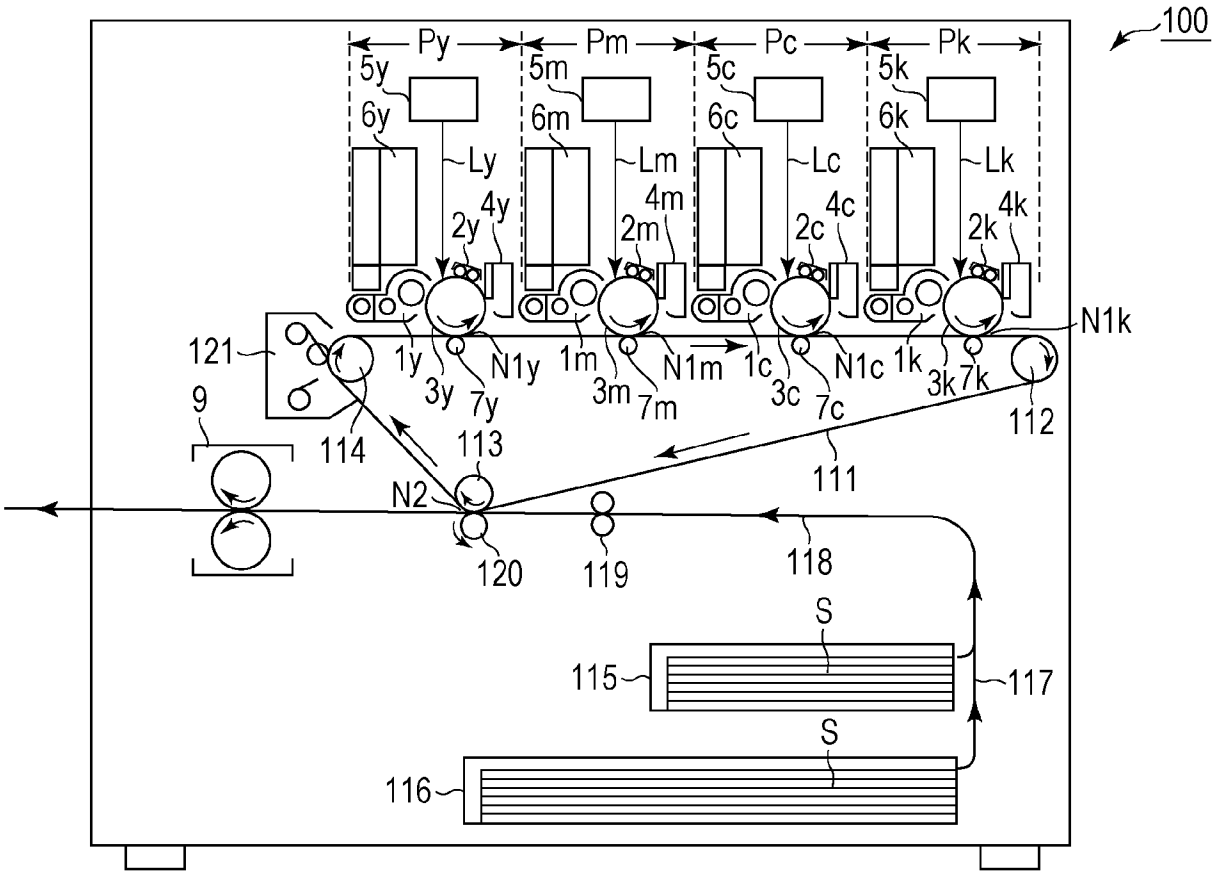
FIG. 1 is a schematic cross-sectional view showing a brief configuration of an image forming apparatus according to an embodiment of the present invention.

FIG. 1 is a schematic cross-sectional view showing a brief configuration of an image forming apparatus according to an embodiment of the present invention. In this embodiment, an image forming apparatus 100 is an electrophotographic tandem image forming apparatus.

The image forming apparatus 100 includes four first, second, third, and fourth image forming units Py, Pm, Pc, and Pk. The four image forming units Py, Pm, Pc, and Pk form toner images of respective colors including yellow (Y), magenta (M), cyan (C), and black (K) through processes of latent-image formation, development, and transfer.

In this embodiment, the configurations and operations of the image forming units Py, Pm, Pc, and Pk are substantially the same except that the colors of toners to be used are different colors. Therefore, unless otherwise the image forming units have to be distinguished from each other, y, m, c, and k, which are added to the ends of reference signs indicative of elements of the first, second, third, and fourth image forming units Py, Pm, Pc, and Pk are omitted, and the elements are collectively described.

The image forming unit P includes a photoconductor drum 3, which is a drum-like electrophotographic photoconductor (a photosensitive member) serving as an image bearing member. The photoconductor drum 3 used in this embodiment is a drum-like OPC (organic photosensitive member). The photoconductor drum 3 has an undercoating layer, a positive-charge-injection prevention layer, a charge generation layer, a charge transport layer, and a surface protection layer arranged on a drum base body made of aluminum and having a diameter of ϕ84 mm in that order from the lower side. When an image is output, the photoconductor drums 3*y*, 3*m*, 3*c*, and 3*k* of the image forming units Py, Pm, Pc, and Pk are rotationally driven in a direction indicated by an arrow in the drawing (counterclockwise), and toner images of the respective colors are formed on outer peripheral surfaces (surfaces) of the photoconductor drums 3*y*, 3*m*, 3*c*, and 3*k*.

An intermediate transfer belt 111, which is an endless belt serving as an intermediate transfer member, is arranged to be adjacent to the photoconductor drums 3*y*, 3*m*, 3*c*, and 3*k* of the image forming units Py, Pm, Pc, and Pk. For example, when a full-color image is formed, the toner images of the respective colors formed on the surfaces of the photoconductor drums 3 are first-transferred on an outer peripheral surface (a surface) of the intermediate transfer belt 111 at respective first transfer parts N1 (Nl*y*,N1*m*,N1*c*,N1*k*), successively in a superposed manner. Also, the toner images first-transferred on the intermediate transfer belt 111 are collectively second-transferred on a recording material S at a second transfer part N2.

The recording material S having the toner image transferred thereon is introduced to an image heating and fixing device 9 serving as fixing means, the toner image is fixed to the recording material S, and the recording material S is output as a recording-image formation product to an output tray (not shown) located outside the image forming apparatus 100. In this way, an image output operation is ended.

To be more specific, the following means are provided around the circumference of the surface of the photoconductor drum 3 along a rotation direction of the photoconductor drum 3. First, a charging device 2 (2*y*, 2*m*, 2*c*, 2*k*) is provided as charging means. Then, a developing device 1(1*y*, l*m*, l*c*, l*k*) is provided as developing means. Then, a first transfer roller (a first-transfer charging device) 7 (7*y*, 7*m*, 7*c*, 7k) is provided as a roller-like first transfer member serving as first transfer means. Then, a cleaner 4 (4*y*, 4*m*, 4*c*, 4*k*) is provided as cleaning means. Also, a laser scanner 5 (5*y*, 5*m*, 5*c*, 5*k*) as an exposure device is provided above the photoconductor drum 3 in the drawing. The laser scanner 5 causes the photoconductor drum 3 to be exposed to light at a position between the charging device 2 and the developing device 1 in the rotation direction of the photoconductor drum 3.

In this embodiment, the photoconductor drum 3 is rotationally driven at a linear velocity (a surface moving speed, a peripheral speed) of 285 mm/s in the direction indicated by the arrow in the drawing (counterclockwise).

The surface of the photoconductor drum 3 after the uniformly charging processing is exposed to laser light L (Ly, Lm, Lc, Lk) and scanned with the laser light L. The laser light L is output from the laser scanner 5 and modulated in accordance with an image signal. The laser scanner 5 includes a light-source device, a polygonal mirror, and fθ lens. In the laser scanner 5, the polygonal mirror rotates and is scanned with the laser light emitted from the light-source device, and the reflection minor deflects the light beam of the scanning light. Then, fθ lens collects the light on the generating line of the surface of the photoconductor drum 3. Accordingly, an electrostatic latent image (an electrostatic image) in accordance with the image signal is formed on the surface of the photoconductor drum 3.

The developing devices 1*y*, 1*m*, 1*c*, and 1*k* respectively house toners of yellow, magenta, cyan, and black as developers. The toners are supplied from toner feed devices 6*y*, 6*m*, 6*c*, and 6*k* respectively to the developing devices 1*y*, 1*m*, 1*c*, and 1*k*. In this embodiment, the expected charge polarity (a normal charge polarity) of the toner for developing the electrostatic latent image on the photoconductor drum 3 is a negative polarity.

The developing device 1 develops (visualizes) the electrostatic latent image on the surface of the photoconductor drum 3 as a toner image. In this embodiment, the toner image is formed by combination of image light exposure and reverse development. That is, the toner image is formed when the toner, which is electrically charged with the same polarity as the charge polarity of the photoconductor drum 3, adheres to the light exposure part on the photoconductor drum 3 having the absolute value of the potential, which is decreased because the photoconductor drum 3 is uniformly electrically charged and then exposed to the light.

The intermediate transfer belt 111 is an endless belt supported with a tension by three rollers of a driving roller 112, a second-transfer facing roller 113, and a driven roller 114, which are arranged in parallel. A driving force is transmitted to the driving roller 112, and hence the intermediate transfer belt 111 is rotationally driven at the same linear velocity (the surface moving speed, the peripheral speed) as the linear velocity of the photoconductor drum 3 in a direction indicated by an arrow in the drawing (clockwise). The first transfer roller 7 is arranged at the inner periphery side of the intermediate transfer belt 111, at a position facing the corresponding photoconductor drum 3. The first transfer roller 7 is pressed to the photoconductor drum 3 through the intermediate transfer belt 111, and forms the first transfer part (a first-transfer nip part) N1 at which the intermediate transfer belt 111 contacts the photoconductor drum 3. Also, a second transfer roller 120, which is a roller-like second transfer member serving as second transfer means, is arranged at the outer periphery side of the intermediate transfer belt 111, at the position facing the second transfer facing roller 113. The second transfer roller 120 is pressed to the second transfer facing roller 113 through the intermediate transfer belt 111, and forms a second transfer part (a second-transfer nip part) N2 at which the intermediate transfer belt 111 contacts the second transfer roller 120.

A toner image of yellow, which is the first color, formed on the surface of the photoconductor drum 3*y* of the first image forming unit Py is first-transferred on the surface of the intermediate transfer belt 111 while the toner image passes through the first transfer part N1*y*. At this time, a direct voltage with the reversed polarity to the normal charge polarity of the toner is applied as a first transfer bias (a first transfer voltage) from a power supply (not shown) to a first transfer roller 7*y*. That is, the yellow toner image is first-transferred on the surface of the intermediate transfer belt 111 by an electric field formed by the first transfer bias applied to the first transfer roller 7*y*, and a pressure. Similarly, toner images of magenta, which is the second color, cyan which is the third color, and black which is the fourth color, formed on the surfaces of the photoconductor drums 3*m*, 3*c*, and 3*k* of the second, third, and fourth image forming units Pm, Pc, and Pk are superposed and first-transferred on the surface of the intermediate transfer belt 111. Accordingly, a composite color toner image corresponding to a subject color image is formed on the surface of the intermediate transfer belt 111.

Meanwhile, predetermined recording materials S among different types of recording materials S stacked on and housed in two sheet-feed cassettes 115 and 116 are separated one by one from one of the sheet-feed cassettes 115 and 116. The separated recording material S passes through sheet paths 117 and 118, and is conveyed to a registration roller 119. The registration roller 119 feeds the recording material S to the second transfer part N2 at a predetermined timing.

A direct voltage with the reversed polarity to the normal charge polarity of the toner is applied as a second transfer bias (a second transfer voltage) from a power supply (not shown) to the second transfer roller 120. Accordingly, the composite color toner image on the surface of the intermediate transfer belt 111 is collectively second-transferred on the recording material S.

The recording material S having the composite color toner image transferred thereon is separated from the surface of the intermediate transfer belt 111 and conveyed to the fixing device 9. Then, the recording material S is heated and pressed by the fixing device 9, and hence the toner image is fixed to the recording material S. Then, the recording material S having the toner image fixed thereto is output to the output tray (not shown) located outside the image forming apparatus 100.

The residual toner on the surface of the photoconductor drum 3 after the first transfer is ended is removed and collected by the cleaner 4. Then, the photoconductor drum 3 is continuously used for the next image formation. Also, the toner and other foreign substance remaining on the surface of the intermediate transfer belt 111 is removed by bringing a cleaning web (an unwoven cloth) 121 into contact with the surface of the intermediate transfer belt 111 and wiping the toner and other foreign substance.

2. Charging Device

Next, a basic configuration of the charging device 2 is described. In this embodiment, the charging devices 2 of the respective image forming units P have the same basic configuration. Also, the photoconductor drums 3 of the respective image forming units P have the same basic configuration.

Figure 2:
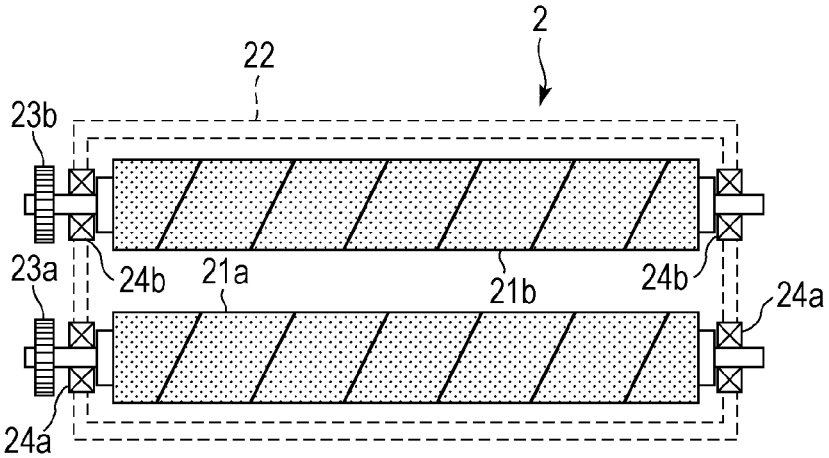
FIG. 2 is a partial cross-sectional side view showing a brief configuration of a charging device used in the image forming apparatus according to the embodiment of the present invention.

As shown in FIG. 2, the charging device 2 includes a first roll brush 21*a* serving as a first charging member (a contact charging member), and a second roll brush 21*b* serving as a second charging member (a contact charging member). Also, the charging device 2 includes a case 22 that supports the first and second roll brushes 21*a* and 21*b* at predetermined positions, and first and second driving gears 23*a* and 23*b* that transmit driving from driving sources (not shown) to the respective first and second roll brushes 21*a* and 21*b*.

The rotation axes of the first and second roll brushes 21*a* and 21*b* are arranged substantially in parallel to the rotation axis of the photoconductor drum 3 (substantially perpendicular to the rotation direction of the photoconductor drum 3). Also, the first roll brush 21*a* is arranged upstream of the second roll brush 21*b* in the rotation direction of the photoconductor drum 3. That is, the second roll brush 21*b* is arranged downstream of the first roll brush 21*a* in the rotation direction of the photoconductor drum 3. The first and second roll brushes 21*a* and 21*b* are rotatably held by the case 22 through bearings 24*a* and 24*b*.

The first and second roll brushes 21*a* and 21*b* contact the surface of the photoconductor drum 3, and hence form first and second charge nip parts Nc1 and Nc2 (see FIGS. 11A and 11B), which are contact parts between the first and second roll brushes 21*a* and 21*b*, and the photoconductor drum 3.

The first and second roll brushes 21*a* and 21*b* are rotationally driven because driving is transmitted from the respective driving sources to the first and second driving gears 23*a* and 23*b*through gear trains (not shown). Then, a predetermined charge bias (a charge voltage) is applied from a power supply (a high voltage power supply) (not shown) serving as charge voltage applying means to the first and second roll brushes 21*a* and 21*b*. In this embodiment, equipotential charge biases are applied to the first and second roll brushes 21*a* and 21*b*. Accordingly, a desirable charge potential for the photoconductor drum 3 is obtained.

3. Roll Brush

Next, basic configurations of the first and second roll brushes 21*a* and 21*b* are described. In this embodiment, the basic configurations of the first and second roll brushes 21*a* and 21*b* are the same. Hence, unless otherwise the first and second roll brushes 21*a* and 21*b* have to be distinguished from each other, the first and second roll brushes 21*a* and 21*b* are collectively described as a roll brush 21.

Figure 3:
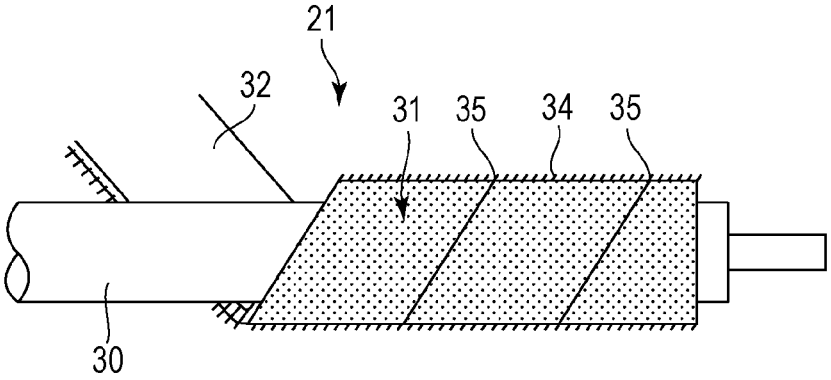
FIG. 3 is a partial exploded side view showing a brief configuration of a roll brush used in the image forming apparatus according to the embodiment of the present invention.

As shown in FIG. 3, the roll brush 21 is formed by helically winding a strip-like base cloth 31, which preparatorily has fibers 34, around an outer peripheral surface of a metal core bar 30 serving as a core material. In this embodiment, the core bar 30 serving as the core material is made of metal such as stainless steel and formed in a cylindrical or columnar shape.

Figure 4:
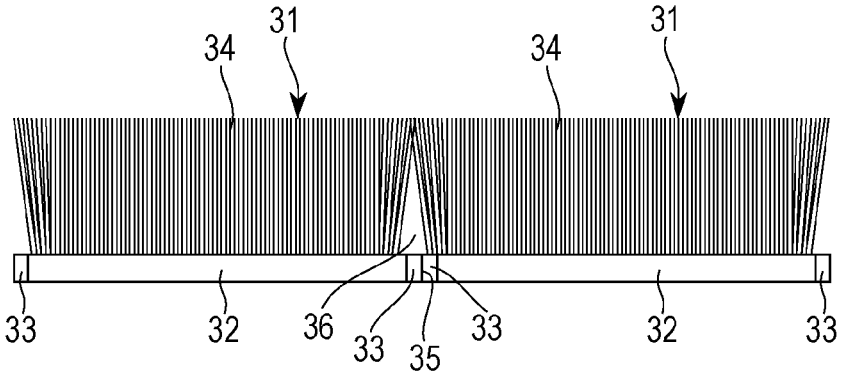
FIG. 4 is an enlarged cross-sectional view showing a base cloth of the roll brush used in the image forming apparatus according to the embodiment of the present invention.

As shown in FIG. 4, the base cloth 31 serving as a base material is formed by implanting the fibers 34 in a base 32. Alternatively, the base cloth 31 may be formed of the fibers 34 by pile weaving in the vertical direction. The fibers 34 may preferably use conductive fibers in which carbon black serving as a conductive material is dispersed in thermoplastic resin, such as nylon, polyester, or acryl.

Also, in this embodiment, to prevent the fibers 34 from being released, a rib 33 without the fibers 34 is provided at an outer edge of the base 32 of the base cloth 31. Hence, the roll brush 21 has a winding gap 36 (a non-fiber part) generated as a seam by the amount of the rib 33 near a winding seam 35, even if the base cloth 31 is closely wound around the core bar 30. The winding seam 35 is a part where ends of the strip-like base cloth 31 in a direction orthogonal to the long-side axial direction (the winding direction) are adjacent to each other. The ends are preferably in contact with each other. However, the ends may be partly separated from each other. If the ends are separated from each other, the gap should be as small as possible, and the gap may be preferably 100 μm or smaller.

In the roll brush 21, the fibers 34 have a relatively high density and tip ends of the fibers 34 are formed to be spread. The fibers 34 are spread to cover the winding gap 36, and hence a charge failure of the photoconductor drum 3 at a position corresponding to the winding gap 36 is restricted. However, the density of the fibers 34 is slightly low by the amount that the fibers 34 cover the winding gap 36. The charge potential (the absolute value) is low, and the charge irregularity (the winding irregularity) may be generated.

In this embodiment, the example is described in which the rib is provided at the outer edge of the base 32 of the base cloth 31. However, even if the base cloth 31 does not have the rib, the tips of the fibers 34 near the outer edge of the base cloth 31 are likely spread outward as shown in FIG. 4. The fibers 34 near the outer edge may be inclined after a long period of use, and hence the charge irregularity (the seam irregularity) may be generated in a region of the photosensitive member facing an area near the seam.

Figure 5:
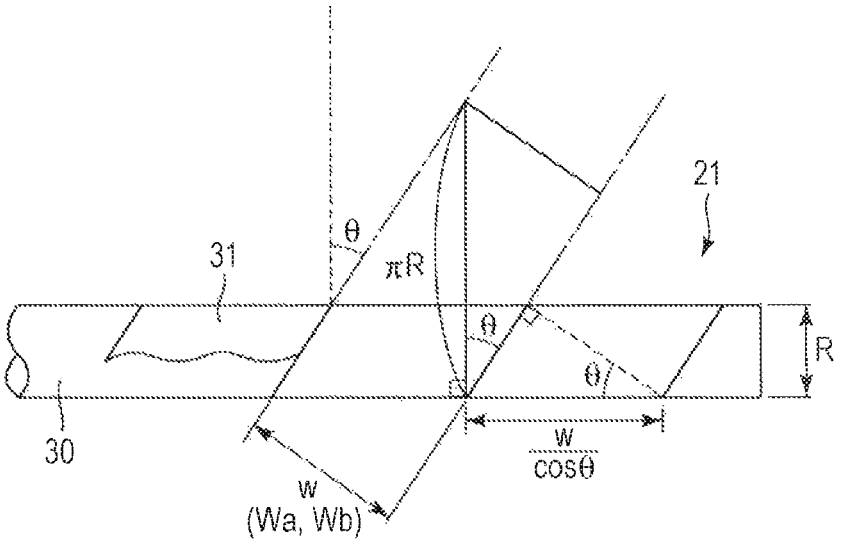
FIG. 5 is a schematic illustration for explaining a winding angle of the base close with respect to a core bar of the roll brush.

As shown in FIG. 5, when the base cloth 31 is wound by one turn, if the base cloth 31 is wound at an angle θ which causes a shift by w/cos θ, the base cloth 31 can be wound around the core bar 30 without a gap. Referring to FIG. 5, the angle of the winding gap 36 of the roll brush 21, that is, the angle of the winding seam 35 is obtained as follows. It is assumed that W is a width in the short-side direction of the base cloth 31 of the roll brush 21, and R is an outer diameter (a diameter) of the core bar 30. At this time, the winding angle θ of the base cloth 31 with respect to the core bar 30 by using the perimeter πR of the core bar 30 and the width W in the short-side direction of the base cloth 31 is as follows:

$$\sin\theta = W/(\pi R),$$

that is, $$\theta = \sin^{-1} W/(\pi R).$$

Figure 6:
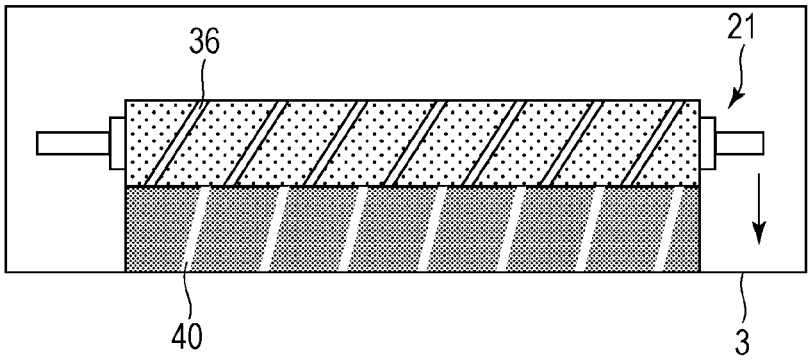
FIG. 6 is a schematic illustration for explaining a charge irregularity on a photoconductor drum generated as the result of a winding gap of the roll brush.

Even if the winding seam 35 is separated when the base cloth 31 is wound around the core bar 30, the winding gap 36 is formed as shown in FIG. 6.

Then, the surface of the photoconductor drum 3 facing the winding gap 36 is not charged or weakly charged, and the charge irregularity (the winding-seam irregularity) may be obliquely generated on the surface of the photoconductor drum 3. The charge irregularity (the winding-seam irregularity) is reflected on the toner image when the developing device 1 performs the developing operation, is transferred on the intermediate transfer belt 111, and finally appears on the output image.

Figure 7:
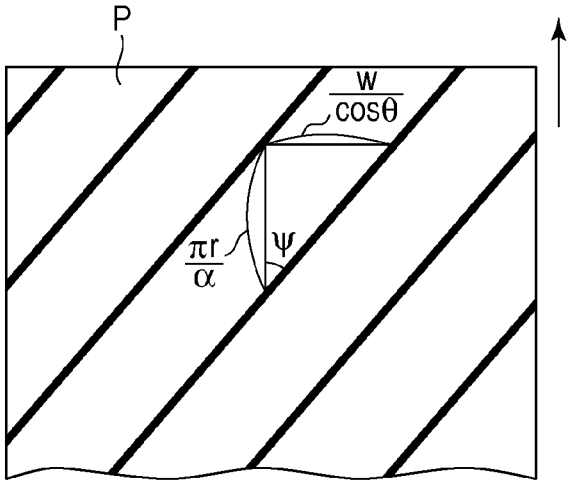
FIG. 7 is a schematic illustration for explaining an angle of an image irregularity (an irregularity angle) on a recording material caused by the charge irregularity on the photoconductor drum generated as the result of the winding gap of the roll brush.

Now, it is assumed that the roll brush 21 with an outer diameter r having the base cloth 31 wound at the angle θ rotates with a to-photosensitive member linear-velocity ratio α while contacting the photoconductor drum 3. It is assumed that ψ is a projection angle at this time of the winding seam 35 of the roll brush 21 onto the photoconductor drum 3 (hereinafter, also referred to as "irregularity angle"). As shown in FIG. 7, the irregularity angle ψ is an angle of an image irregularity on the recording material S possibly generated by the winding gap 36 of the roll brush 21, with respect to an image forming direction (a conveyance direction of the recording material S), for example, if the use amount of the roll brush 21 is increased. As shown in FIGS. 5 and 7, a shift is made by a winding-seam horizontal width (W/cos θ) at a distance for one turn of the roll brush 21 (πr/α). Hence, an expression is established as follows:

$$\tan\psi = (W/\cos\theta)/(\pi r/\alpha) = \alpha W/(\pi r\cos\theta).$$

Also, based on an expression as follows:

$$W = \pi R\sin\theta W,$$

an expression is established as follows:

$$\tan\psi = \alpha(R/r)\tan\theta.$$

The irregularity angle ψ is obtained by the expression.

A sign of the to-photosensitive member linear-velocity ratio α (=(linear velocity of roll brush)/(linear velocity of photoconductor drum)) represents a rotation direction of the roll brush 21. In case of plus, the photoconductor drum 3 and the roll brush 21 rotate in opposite directions (at mutually facing parts, the same direction). In case of minus, the photoconductor drum 3 and the roll brush 21 rotate in the same direction (at mutually facing parts, opposite directions). That is, the linear velocity of the photoconductor drum 3 is expressed by a plus value. Also, if the roll brush 21 rotates so that the roll brush 21 and the photoconductor drum 3 move in the same direction at the mutually facing parts, the linear velocity of the roll brush 21 is expressed by a plus value. In contrast, if the roll brush 21 rotates so that the roll brush 21 and the photoconductor drum 3 move in a reversed direction at the mutually facing parts, the linear velocity of the roll brush 21 is expressed by a minus value.

4. Restriction of Winding-Seam Irregularity

Next, a method of restricting a winding-seam irregularity in the charging device 2 of this embodiment is described.

Figure 8:
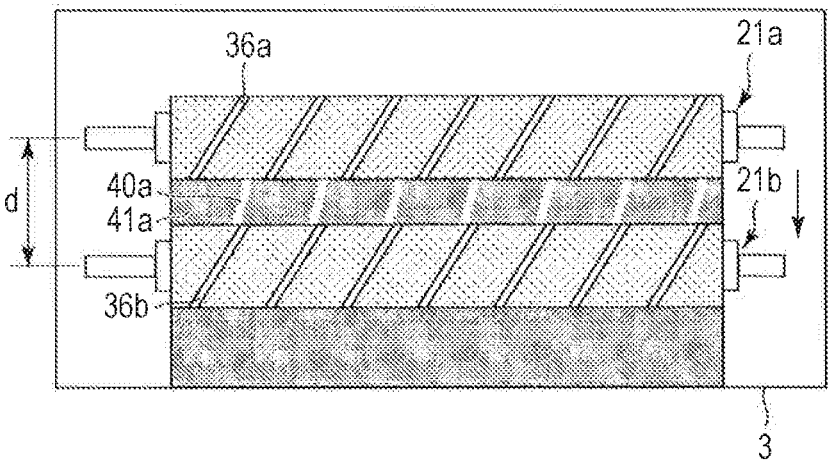
FIG. 8 is a schematic illustration for explaining a restriction effect for the winding-seam irregularity.

As shown in FIG. 8, a winding-seam irregularity (a non-charge part) 40*a* is generated on the surface of the photoconductor drum 3 at the nip part between the first roll brush 21*a*, which is arranged at the upstream side in the rotation direction of the photoconductor drum 3, and the photoconductor drum 3. That is, a charge part 41*a* electrically charged with a desirable potential and the non-charge part 40*a* not electrically charged are conveyed to the downstream side in the rotation direction of the photoconductor drum 3 in a mixed manner. Then, the non-charge part 40*a* is electrically charged with a desirable charge potential at the nip part between the second roll brush 21*b*, which is arranged at the downstream side in the rotation direction of the photoconductor drum 3, and the photoconductor drum 3. In this way, the surface potential of the photoconductor drum 3 after the passage through the nip part between the second roll brush 21*b* and the photoconductor drum 3 becomes substantially uniform, and the winding-seam irregularity is restricted.

As described above, to cancel the winding-seam irregularity, it is important that the winding-seam irregularity (the non-charge part) 40*a* by the first roll brush 21*a* is not superposed on the winding gap 36*b* of the second roll brush 21*b* at the nip part between the second roll brush 21*b* and the photoconductor drum 3. That is, it is important that the winding-seam irregularity (the non-charge part) 40*a* by the first roll brush 21*a* does not intersect with or is not superposed on the winding-seam irregularity (the non-charge part) 40*b* (see FIG. 11A) by the second roll brush 21*b*.

If the winding-seam irregularities 40*a* and 40*b* by the first and second roll brushes 21*a* and 21*b* intersect with each other or are superposed on each other, the fibers 34 of the second roll brush 21*b* do not contact the non-charge part 40*a*, which has not been electrically charged by the first roll brush 21*a*. Hence, the non-charge part 40*a* not electrically charged by the first roll brush 21*a* cannot be electrically charged by the second roll brush 21*b*. Consequently, the winding-seam irregularity (non-charge part) 40*b* is generated on the surface of the photoconductor drum 3 after the passage through the nip part between the second roll brush 21*b* and the photoconductor drum 3.

Figure 9:
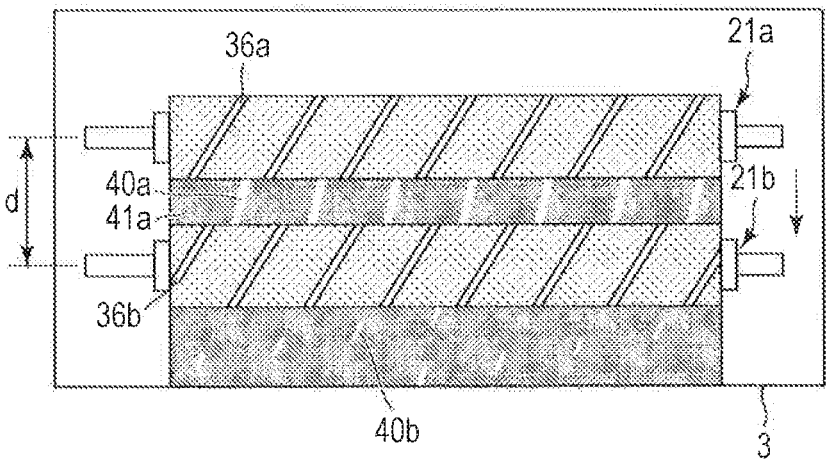
FIGS. 9A and 9B are schematic illustrations for explaining generation states of winding-seam irregularities.
Figure 9:
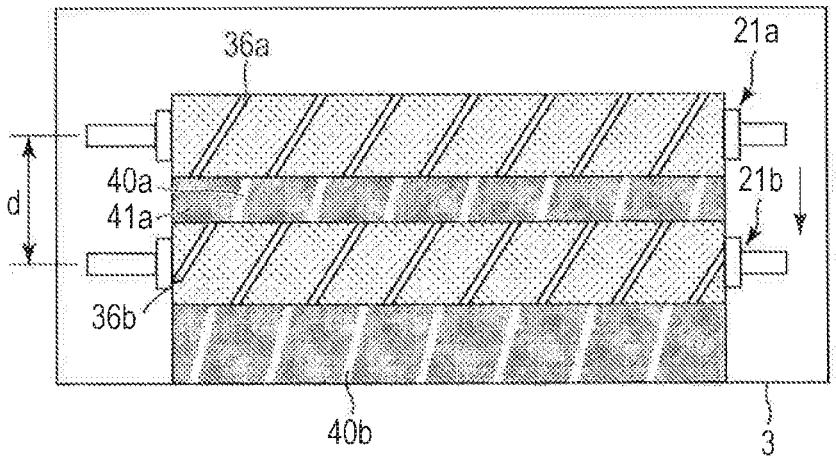

If the winding-seam irregularities 40*a* and 40*b* by the first and second roll brushes 21*a* and 21*b* intersect with each other, a dot-like charge irregularity as shown in FIG. 9A is generated. Also, if the winding-seam irregularities 40*a* and 40*b* by the first and second roll brushes 21*a* and 21*b* are superposed on each other, a strip-like charge irregularity as shown in FIG. 9B is generated.

To prevent the winding-seam irregularities 40*a* and 40*b* by the first and second roll brushes 21*a* and 21*b* from intersecting with each other, the irregularity angles ψ of the first and second roll brushes 21*a* and 21*b* may be equalized.

A case in which the irregularity angles ψ are equal is not only a case in which the irregularity angles ψ are completely equal. For example, a difference of ±0.2° is allowed because the frequency of generation of the charge irregularity is less and the charge irregularity can be generated between continuous images (an area between sheets).

This state can be provided by adjusting the outer diameter of the core bar 30, the outer diameter of the roll brush 21, the width of the base cloth 31, the winding direction of the base cloth 31, the to-photosensitive member linear-velocity ratio α, and the rotation direction of the roll brush 21. Hereinafter, the outer diameter of the core bar 30 is also referred to as "core-bar outer diameter," the outer diameter of the roll brush 21 is also referred to as "brush outer diameter," and the width of the base cloth 31 is also referred to as "base-cloth width." It is to be noted that the outer diameter of the core bar 30 is a diameter of the core bar 30 in a cross section perpendicular to the rotation-axis direction of the core bar 30. Also, the width of the base cloth 31 is a length in the direction orthogonal to the long-side axial direction of the strip-like base cloth 31. Also, the outer diameter of the roll brush 21 is represented by a diameter of an imaginary circle (a circumcircle) of a brush having a roller-like shape as a whole and formed of a plurality of fibers, in a cross section perpendicular to the rotation-axis direction of the roll brush 21 while not contacting the photoconductor drum 3 (a natural state).

Figure 10A:
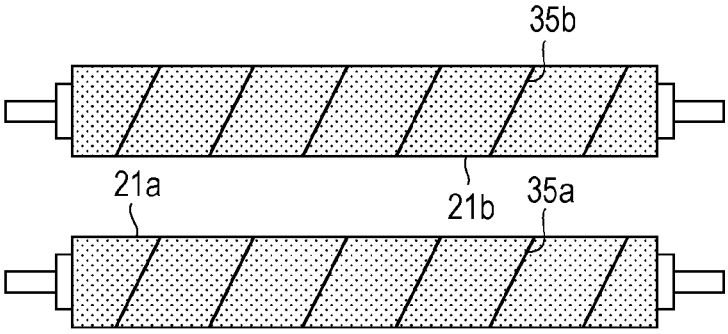
FIGS. 10A and 10B are schematic illustrations for explaining winding directions of base clothes on first and second roll brushes.
Figure 10B:
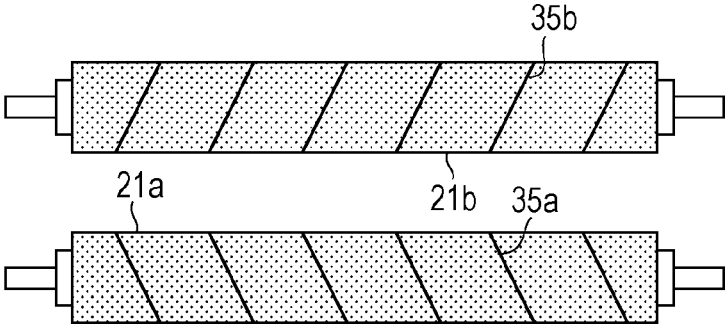

The winding directions of the base cloth 31 are the same like FIG. 10A if the rotation directions of the first and second roll brushes 21*a* and 21*b* are the same. That is, when the first and second roll brushes 21*a* and 21*b* are viewed from one side surface while the first and second roll brushes 21*a* and 21*b* are mounted in the image forming apparatus 100, the base cloth 31 is wound so that inclination directions of the winding seams 35*a* and 35*b* with respect to the rotation-axis direction of the first and second roll brushes 21*a* and 21*b* are the same. Also, if the rotation directions of the first and second roll brushes 21*a* and 21*b* are reversed, the winding directions are reversed like FIG. 10B. That is, when the first and second roll brushes 21*a* and 21*b* are viewed from the one side surface while the first and second roll brushes 21*a* and 21*b* are mounted in the image forming apparatus 100, the base cloth 31 is wound so that the inclination directions of the winding seams 35*a* and 35*b* with respect to the rotation-axis direction of the first and second roll brushes 21*a* and 21*b* are reversed.

To prevent the winding-seam irregularities 40*a* and 40*b* by the first and second roll brushes 21*a* and 21*b* from being superposed on each other, the following countermeasure may be employed. In particular, the irregularity angles ψ of the first and second roll brushes 21*a* and 21*b* may be equalized as described above, and further an angle difference (a phase difference) may be provided between the rotation directions of the first and second roll brushes 21*a* and 21*b*.

Figure 11:
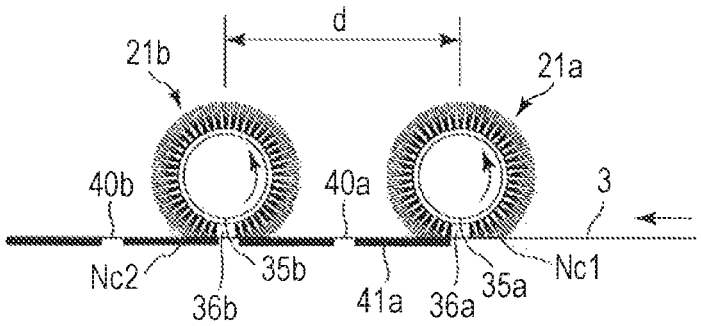
FIGS. 11A and 11B are schematic illustrations for explaining a difference between angles of the first and second roll brushes.
Figure 11:
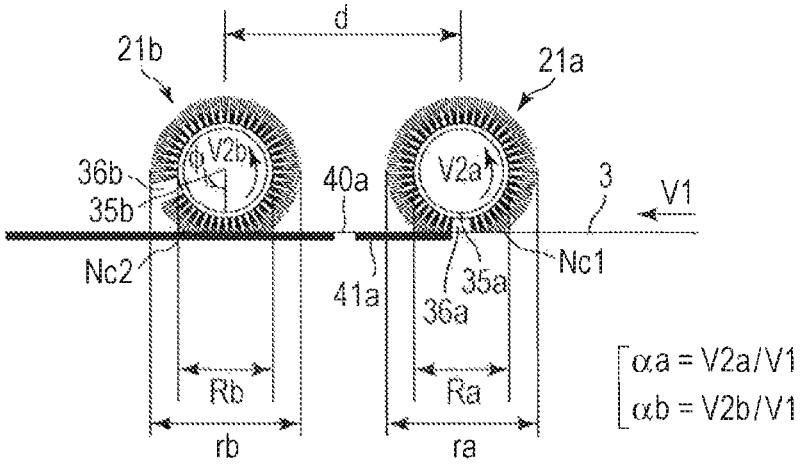

Referring to FIGS. 11A and 11B, the relationship of the angle difference (the phase difference) between the first and second roll brushes 21*a* and 21*b* with respect to the winding-seem irregularities is described. FIGS. 11A and 11B are each a cross-sectional view perpendicular to the rotation-axis direction of the first and second roll brushes 21*a* and 21*b* and the photoconductor drum 3 when the winding seam 35*a* of the first roll brush 21*a* (i.e., the winding gap 36*a* serving as the seam) faces the photoconductor drum 3.

It is assumed that Ra is a core-bar outer diameter of the first roll brush 21*a*, ra is a brush outer diameter, Wa (W) is a width in the short-side direction of the base cloth, and αa is a to-photosensitive member linear-velocity ratio. It is assumed that Rb is a core-bar outer diameter of the second roll brush 21*b*, rb is a brush outer diameter, Wb is a width in the short-side direction of the base cloth, and αb is a to-photosensitive member linear- velocity ratio. αa and αb are defined as follows. In particular, it is assumed that V1 is a linear velocity of the photosensitive member, and V2*a*and V2*b* are linear velocities of the first and second charging members. Herein, V2*a* and V2*b* are plus values if the charging members move in the same direction as the direction of the photosensitive member at the contact parts with the photosensitive member, and are minus values if the charging members move in opposite directions. At this time, $\alpha a$ and $\alpha b$ are respectively expressed by V2*a*/V1 and V2*b*/V1.

A case is considered first in which the distance d between the first roll brush 21*a* and the second roll brush 21*b* is set at an integral multiple of a distance for one turn of the first roll brush 21*a* ($\pi ra/|\alpha a|$).

It is to be noted that the distance d between the first roll brush 21*a* and the second roll brush 21*b* is a distance between the centers of the charge nip parts Nc1 and Nc2 in the surface moving direction of the photoconductor drum 3 (hereinafter, also referred to as "inter-nip distance").

The angle difference $\phi$ between the first and second roll brushes 21*a* and 21*b* is an angle described below in a case in which cross sections perpendicular to the rotation-axis direction of the first and second roll brushes 21*a* and 21*b* are viewed when the winding seam 35*a* of the first roll brush 21*a* faces the photoconductor drum 3 as shown in FIG. 11B. That is, the angle difference $\phi$ is an angle (a phase) of a difference between a phase position of the winding seam 35*a* in the rotation direction with respect to the rotation center of the first roll brush 21*a* and a phase position of the winding seam 35*b* in the rotation direction with respect to the rotation center of the second roll brush 21*b*. In other words, the angle difference $\phi$ is an angle defined by a straight line extending from the winding seam 35*b* of the second roll brush 21*b* to the rotation center of the second roll brush 21*b*, and a reference line extending from the facing part between the second roll brush 21*b* and the photoconductor drum 3 to the rotation center of the second roll brush 21*b*. The sign of the angle is determined so that the direction opposite to the rotation direction of the second roll brush 21*b* with respect to the reference line is plus.

As shown in FIG. 11A, when the winding seams 35*a* and 35*b* of the first and second roll brushes 21*a* and 21*b* simultaneously face the photoconductor drum 3, the angle difference between the first and second roll brushes 21*a* and 21*b* is 0°. In this case, as described above, if the inter-nip distance d is an integral multiple of the distance for one turn of the first roll brush 21*a* ($\pi ra/|\alpha a|$) of the first roll brush 21*a*, the non-charge part 40*a* by the first roll brush 21*a* and the winding gap 36*b* of the second roll brush 21*b* are superposed on each other, and hence the winding-seam irregularity is generated. However, as shown in FIG. 11B, if the angle difference $\phi$ is provided between the first and second roll brushes 21*a* and 21*b*, the non-charge part 40*a* by the first roll brush 21*a* is electrically charged by the second roll brush 21*b*, and hence the winding-seam irregularity is not generated.

Next, when the angle difference $\phi$ is provided between the first and second roll brushes 21*a* and 21*b*, a condition is considered, under which the non-charge part 40*a* by the first roll brush 21*a* and the winding gap 36*b* of the second roll brush 21*b* are superposed on each other and the winding-seam irregularity is generated.

If the inter-nip distance d satisfies the following expression for an integer N being equal to or larger than 0, $$N(\pi ra/|\alpha a|)\leq d<(N+1)(\pi ra/|\alpha a|),$$

in a period from when the winding seam 35*a* of the first roll brush 21*a* (that is, the winding gap 36*a*) faces the photoconductor drum 3 and until when the first roll brush 21*a* rotates by N rotations, the surface of the photoconductor drum 3 moves as follows:

$$N(\pi ra/|\alpha a|).$$

Then, when the second roll brush 21*b* rotates by the angle $\phi$, the winding seam 35*b* of the second roll brush 21*b* (that is, the winding gap 36*b*) faces the photoconductor drum 3. Meantime, the photoconductor drum 3 moves by a distance as follows:

$$\pi rb\phi/(360|\alpha b|).$$

That is, if the inter-nip distance d satisfies the following expression, $$d=N(\pi ra/|\alpha a|)+\pi rb\phi/(360|\alpha b|),$$

the winding-seam irregularity is generated.

Herein, to fix the angle difference $\phi$, for example, the numbers of teeth of the driving gears 23*a* and 23*b* are equalized, and driving is transmitted from the same driving source. In this embodiment, such a configuration is provided. Otherwise, there is a method of fixing the angle difference $\phi$ by controlling the numbers of rotations of the first and second roll brushes 21*a* and 21*b* by detecting the reference positions of the first and second roll brushes 21*a* and 21*b* by using sensors.

With regard to the above description, the following condition is derived as a condition for restricting the winding-seam irregularity. In particular, it is assumed that Ra is a core-bar outer diameter of the first roll brush 21*a*, ra is a brush outer diameter, Wa is a width in the short-side direction of the base cloth, and $\alpha a$ is a to-photosensitive member linear-velocity ratio. It is assumed that Rb is a core-bar outer diameter of the second roll brush 21*b*, rb is a brush outer diameter, Wb is a width in the short-side direction of the base cloth, and $\alpha b$ is a to-photosensitive member linear-velocity ratio. Also, $\phi$ is an angle difference between the first and second roll brushes 21*a* and 21*b*. In this case, the irregularity angle $\psi$ satisfies the following conditions, $$\tan\psi=|\alpha a|(Ra/ra)\tan(\sin^{-1} Wa/(\pi Ra))=|\alpha b|(Rb/rb)\tan(\sin^{-1} Wb/(\pi Rb)),\text{ and}$$

the inter-nip distance d satisfies the following relationship, $$d\neq N\pi ra/|\alpha a|+\pi rb\phi/(360|\alpha b|).$$

If the condition is satisfied, the winding-seam irregularity can be restricted.

It is to be noted that N is any integer equal to or larger than 0, and the angle difference $\phi$ is in a range of $0\leq<360°$.

As described above, the charging device 2 of this embodiment includes a plurality of the roll brushes 21 in the rotation direction of the photoconductor drum 3, the strip-like base cloth 31 being wound around each roll brush 21, the conductive fibers being implanted in the outer peripheral surface of the cylindrical or columnar rotatable core bar 30. The roll brushes 21 are brought into contact with the photoconductor drum 3, and a voltage is applied to the roll brushes. Thus, the charging processing is performed on the surface of the photoconductor drum 3. The plurality of roll brushes 21 are set so that the regions in which the charging processing is not performed on the surface of the photoconductor drum 3 (the regions facing the seams, the winding-seam irregularities) 40*a* and 40*b* corresponding to the winding seams 35 of the base cloth 31 are not superposed on each other. Herein, the regions 40*a* and 40*b* are only required not to be superposed on each other at least in the image formation region in the rotation-axis direction of the photoconductor drum 3. Typically, the regions 40*a* and 40*b* are configured not to be superposed on each other in the entire region of the contact parts between the first and second roll brushes 21*a* and 21*b*, and the photoconductor drum 3 in the rotation-axis direction of the photoconductor drum 3. By setting the plurality of roll brushes 21 so that the winding seam irregularities 40*a* and 40*b* of the roll brushes 21 are not superposed on each other, the roll brush 21 arranged at the downstream side in the rotation direction of the photoconductor drum 3 eliminates or reduces the winding-seam irregularity generated by the roll brush 21 arranged at the upstream side. Accordingly, a good image in which the influence of the charge irregularity (the winding-seam irregularity) is restricted can be output.

5. Evaluation

In the following examples and comparative examples, the roll brushes 21 with various settings were used, images were output from the image forming apparatus 100 shown in FIG. 1, and the restriction effects for the winding-seam irregularities were visually evaluated.

In the following examples and comparative examples, an image output on a first sheet since replacement with new first and second roll brushes 21*a* and 21*b*, an image output on a 30000th sheet after continuous image output, and an image output on a 50000th sheet after further continuous image output were evaluated.

Also, the visual evaluation was performed by using a halftone image with a black toner because even a slight winding-seam irregularity is easily found.

EXAMPLE 1

In this example, the linear velocity of the photoconductor drum 3 is 285 mm/s. In this example, the basic configurations of the first and second roll brushes 21*a* and 21*b* are substantially the same.

The first and second roll brushes 21*a* and 21*b* had various settings as follows. The core-bar outer diameter Ra was 16 mm, the brush outer diameters ra and rb were each 24 mm, and the widths Wa and Wb in the short-side direction of the base cloth as the base material were each 15 mm. Also, inclined-fiber processing was provided. The fibers 34 of the roll brush 21 were formed by dispersing carbon black in nylon, and a filament had a fineness of 0.6 Tex. The base cloth 31 in which the fibers 34 were implanted with a density of 188 fibers/mm$^2$ was used. When the roll brush 21 was brought into contact with an aluminum cylinder, a voltage with 10 V was applied to the roll brush 21, and an electrical resistance value was measured. The electrical resistance value was $3.0\times10^6\Omega$. In this example, the irregularity angles ψ of the first and second roll brushes 21*a* and 21*b* were each 32.0°.

Herein, the inclined-fiber processing was specifically provided by the following method. The first and second roll brushes 21*a* and 21*b* were inserted into pipes with smaller inner diameters than the outer diameters of the first and second roll brushes 21*a* and 21*b* while being rotated in the same direction as the rotation direction during the charging operation, and bending directions of the fibers 34 were aligned. Then, each of the first and second roll brushes 21*a* and 21*b* and the pipe were coaxially held, the held state was continued for a predetermined time, and then the pipes were removed.

Also, various settings of the charging device 2 were provided as follows. The to-photosensitive member linear-velocity ratios αa and αb of the first and second roll brushes 21*a* and 21*b* were each −3.0, the inter-nip distance d was 30 mm, and the angle difference ϕ between the first and second roll brushes 21*a* and 21*b* was 0°. Also, charge biases applied to the first and second roll brushes 21*a* and 21*b* were each a DC voltage of −1050 V. Accordingly, a charge potential of −600 V was obtained for the photoconductor drum 3.

Consequently, the winding-seam irregularity was not generated in any of the image on the first sheet after the replacement with the new first and second roll brushes 21*a* and 21*b*, the image output on the 30000th sheet, and the image output on the 50000th sheet.

In this example, the first and second roll brushes 21*a* and 21*b* having substantially the same configurations were used, the irregularity angles ψ of the roll brushes were set to be the same, and the inter-nip distance d satisfied the above-mentioned conditional expression. Accordingly, the generation of the winding-seam irregularity could be restricted.

The result was described in Table 1 with examples and comparative examples described later.

COMPARATIVE EXAMPLE 1

In this comparative example, the following point was changed from Example 1.

The to-photosensitive member linear-velocity ratio αa of the first roll brush 21*a* was −2.0. For other points, the charging device 2 in this comparative example had substantially the same configuration as the configuration of the charging device 2 used in Example 1.

In particular, the irregularity angles ψ of the first and second roll brushes 21*a* and 21*b* were respectively 22.6° and 32.0° so that the winding-seam irregularities 40*a* and 40*b* by the first and second roll brushes 21*a* and 21*b* intersected with each other.

Consequently, the winding-seam irregularity was not generated in the image output with the new first and second roll brushes 21*a* and 21*b*. However, as the image output was repeated, the bundle of fibers was split from the part at the winding gap, and the inclined-fiber processing was collapsed. Owing to this, a dot-like winding-seam irregularity as shown in FIG. 9A slightly appeared on the 30000th sheet, and the winding-seam irregularity became noticeable on the 50000th sheet.

COMPARATIVE EXAMPLE 2

In this comparative example, the following point was changed from Example 1.

The angle difference ϕ between the first and second roll brushes 21*a* and 21*b* was 69.7°. For other points, the charging device 2 in this comparative example had substantially the same configuration as the configuration of the charging device 2 used in Example 1.

In particular, the winding-seam irregularities 40*a* and 40*b* by the first and second roll brushes 21*a* and 21*b* were set to be superposed on each other.

Consequently, the winding-seam irregularity was not generated in the image output with the new first and second roll brushes 21*a* and 21*b*. However, as the image output was repeated, the bundle of fibers was split from the part at the winding gap, and the inclined-fiber processing was collapsed. Owing to this, a strip-like winding-seam irregularity as shown in FIG. 9B slightly appeared on the 30000th sheet, and the winding-seam irregularity became noticeable on the 50000th sheet. The irregularity angle ψ at this time was 32.0°.

EXAMPLE 2

In this example, the following points were changed from Example 1.

Figure 12:
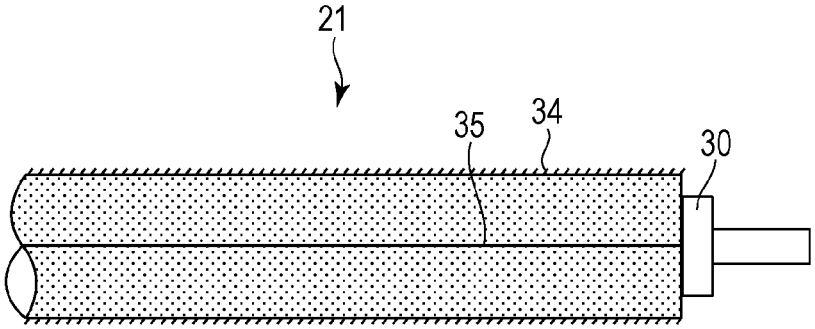
FIG. 12 is a side view showing a brief configuration of a roll brush according to a second embodiment.

The first and second roll brushes 21*a* and 21*b* as shown in FIG. 12 were used, in which the base cloth 31 serving as the base material was wound so that the winding seam 35 serving as the seam was parallel to the generating line (the rotation axis) of the core bar 30. Hence, in this example, the base-cloth widths Wa and Wb are different from those in Example 1, and are each 50.3 mm (the perimeter of the core bar 30 of each of the first and second roll brushes 21*a* and 21*b*). In this example, the irregularity angles ψ of the first and second roll brushes 21*a* and 21*b* are each 90.0°. For other points, the charging device 2 used in this example had substantially the same configuration as the configuration of the charging device 2 used in Example 1.

Consequently, the winding-seam irregularity was not generated in any of the image on the first sheet after the replacement with the new first and second roll brushes 21*a* and 21, the image output on the 30000th sheet, and the image output on the 50000th sheet.

In this embodiment, the first and second roll brushes 21*a* and 21*b* having substantially the same configuration were used, the irregularity angles ψ of the roll brushes were set to be the same, and the inter-nip distance d satisfied the above-mentioned conditional expression. Accordingly, the generation of the winding-seam irregularity could be restricted.

COMPARATIVE EXAMPLE 3

In this comparative example, the following point was changed from Example 2.

The angle difference ϕ between the first and second roll brushes 21*a* and 21*b* was 69.7°. For other points, the charging device 2 in this comparative example had substantially the same configuration as the configuration of the charging device 2 used in Example 2.

In particular, the winding-seam irregularities 40*a* and 40*b* by the first and second roll brushes 21*a* and 21*b* were set to be superposed on each other.

Consequently, the winding-seam irregularity was not generated in the image output with the new first and second roll brushes 21*a* and 21. However, as the image output was repeated, the bundle of fibers was split from the part at the winding gap, and the inclined-fiber processing was collapsed. Owing to this, a strip-like winding-seam irregularity slightly appeared on the 30000th sheet, and the winding-seam irregularity became noticeable on the 50000th sheet. The irregularity angle ψ at this time is 90.0°.

EXAMPLE 3

In this example, the following points were changed from Example 1.

The brush outer diameter rb and the to-photosensitive member linear-velocity ratio αb of the second roll brush 21*b* were changed. For other points, the charging device 2 in this comparative example had substantially the same configuration as the configuration of the charging device 2 used in Example 1.

In particular, the second roll brush 21*b* had various settings as follows. The core-bar outer diameter Rb was 16 mm, the brush outer diameter rb was 28 mm, and the base-cloth width Wb was 15 mm. Also, inclined-fiber processing was provided. The winding direction of the base cloth 31 was the same as the winding direction of the first roll brush 21*a*. In this example, the irregularity angles ψ of the first and second roll brushes 21*a* and 21*b* were each 32.0°.

Also, various settings of the charging device 2 were provided as follows. The to-photosensitive member linear-velocity ratio αb of the second roll brush 21*b* was −3.5, the inter-nip distance d was 30 mm, and the angle difference ϕ between the first and second roll brushes 21*a* and 21*b* was 0°.

Consequently, the winding-seam irregularity was not generated in any of the image on the first sheet after the replacement with the new first and second roll brushes 21*a* and 21, the image output on the 30000th sheet, and the image output on the 50000th sheet.

In this example, the second roll brush 21*b* with the different brush outer diameter was used. However, since the to-photosensitive member linear-velocity ratio α was set so that the irregularity angles ψ of the respective roll brushes are the same, and the inter-nip distance d satisfied the above-mentioned conditional expression, the generation of the winding-seam irregularity could be restricted.

COMPARATIVE EXAMPLE 4

In this comparative example, the following point was changed from Example 3.

The angle difference ϕ between the first and second roll brushes 21*a* and 21*b* was 69.7°. For other points, the charging device 2 in this comparative example had substantially the same configuration as the configuration of the charging device 2 used in Example 3.

In particular, the winding-seam irregularities 40*a* and 40*b* by the first and second roll brushes 21*a* and 21*b* were set to be superposed on each other.

Consequently, the winding-seam irregularity was not generated in the image output with the new first and second roll brushes 21*a* and 21. However, as the image output was repeated, the bundle of fibers was split from the part at the winding gap, and the inclined-fiber processing was collapsed. Owing to this, a strip-like winding-seam irregularity as shown in FIG. 9B slightly appeared on the 30000th sheet, and the winding-seam irregularity became noticeable on the 50000th sheet. The irregularity angle ψ at this time was 32.0°.

EXAMPLE 4

In this example, the following points were changed from Example 1.

The core-bar outer diameter Ra, the brush outer diameter ra, and the base-close width Wa of the first roll brush 21*a* were changed. For other points, the charging device 2 in this comparative example had substantially the same configuration as the configuration of the charging device 2 used in Example 1.

In particular, the first roll brush 21*a* had various settings as follows. The core-bar outer diameter Ra was 12.0 mm, the brush outer diameter ra was 18.0 mm, and the base-cloth width Wa was 11.25 mm. Also, the inclined-fiber processing was provided. The winding direction of the base cloth 31 was the same as the winding direction of the second roll brush 21. In this example, the irregularity angles ψ of the first and second roll brushes 21*a* and 21*b* were each 32.0°.

Also, various settings of the charging device 2 were provided as follows. The to-photosensitive member linear-velocity ratio αa of the first roll brush 21*a* was −3.0, the inter-nip distance d was 30 mm, and the angle difference ϕ between the first and second roll brushes 21*a* and 21*b* was 0°.

In this example, the second roll brush 21*b* rotates three turns every time when the first roll brush 21*a* rotates four turns. Accordingly, although the angle difference ϕ increases by 90° every rotation of the first roll brush 21*a*, the winding-seam irregularities are not superposed.

Consequently, the winding-seam irregularity was not generated in any of the image on the first sheet after the replacement with the new first and second roll brushes 21*a* and 21, the image output on the 30000th sheet, and the image output on the 50000th sheet.

In this example, the first roll brush 21*a* with the different core-bar outer diameter, brush outer diameter, and base-close width was used. However, since the irregularity angles ψ of the respective roll brushes are the same and the inter-nip distance d satisfied the above-mentioned conditional expression, the generation of the winding-seam irregularity could be restricted.

COMPARATIVE EXAMPLE 5

In this comparative example, the following point was changed from Example 4.

The angle difference ϕ between the first and second roll brushes 21*a* and 21*b* was 69.7°. For other points, the charging device 2 in this comparative example had substantially the same configuration as the configuration of the charging device 2 used in Example 4. This setting is that when the first roll brush 21*a* rotates four turns, the second roll brush 21*b* rotates three turns, and the winding-seam irregularities are superposed on each other.

Consequently, the winding-seam irregularity was not generated in the image output with the new first and second roll brushes 21*a* and 21. However, as the image output was repeated, the bundle of fibers was split from the part at the winding gap, and the inclined-fiber processing was collapsed. Owing to this, a strip-like winding-seam irregularity as shown in FIG. 9B slightly appeared on the 30000th sheet, and the winding-seam irregularity became noticeable on the 50000th sheet. The irregularity angle ψ at this time was 32.0°. In this comparative example, the winding-seam irregularity was generated every time when the first roll brush 21*a* rotated four turns.

EXAMPLE 5

In this example, the following points were changed from Example 1.

In this example, an amorphous silicon photosensitive member was used for the photoconductor drum 3. The photoconductor drum 3 used in this example is an amorphous silicon photosensitive member with a negative charge. The photoconductor drum 3 has a positive-charge-injection prevention layer, a photoconductive layer, a negative-charge block layer, and a surface protection layer arranged on a drum base body made of aluminum and having a diameter of ϕ84 mm in that order from the lower side.

Also, in this example, charging processing was performed on the photoconductor drum 3 by changing electrical resistances of fibers of the first and second roll brushes 21*a* and 21, and charge biases applied to the first and second roll brushes 21*a* and 21. Other conditions are the same as the conditions of Example 1.

In particular, in this example, the fibers 34 of the roll brush 21 were formed by dispersing carbon black in nylon similarly to Example 1. However, the amount of carbon black was increased, and the fibers 34 with a lower electrical resistance than the electrical resistance of the fibers of Example 1 were used. A filament of the fibers 34 had a fineness of 0.6 Tex. The base cloth 31 in which the fibers 34 were implanted with a density of 188 fibers/mm$^2$ was used. When the roll brush 21 was brought into contact with an aluminum cylinder, a voltage with 10 V was applied to the roll brush 21, and an electric resistance value was measured. The electric resistance value was $2.5\times10^5\Omega$. In this example, the irregularity angles ψ of the first and second roll brushes 21*a* and 21*b* were each 32.0°.

Also, charge biases applied to the first and second roll brushes 21*a* and 21*b* were each a DC voltage of −700 V. Accordingly, a charge potential of −650 V was obtained for the photoconductor drum 3.

In this example, since the charging processing was performed on the photoconductor drum 3 by the injection charging method, the absolute values of the charge biases applied to the first and second roll brushes 21*a* and 21*b* could be smaller than the absolute values in Example 1.

Consequently, the winding-seam irregularity was not generated in any of the image on the first sheet after the replacement with the new first and second roll brushes 21*a* and 21, the image output on the 30000th sheet, and the image output on the 50000th sheet.

In this embodiment, the first and second roll brushes 21*a* and 21*b* having substantially the same configuration were used, the irregularity angles ψ of the roll brushes were set to be the same, and the inter-nip distance d satisfied the above-mentioned conditional expression. Accordingly, the generation of the winding-seam irregularity could be restricted.

COMPARATIVE EXAMPLE 6

In this comparative example, the following point was changed from Example 5.

The angle difference ϕ between the first and second roll brushes 21*a* and 21*b* was 69.7°. For other points, the charging device 2 in this comparative example had substantially the same configuration as the configuration of the charging device 2 used in Example 5.

In particular, the winding-seam irregularities 40*a* and 40*b* by the first and second roll brushes 21*a* and 21*b* were set to be superposed on each other.

Consequently, the winding-seam irregularity was not generated in the image output with the new first and second roll brushes 21*a* and 21. However, as the image output was repeated, the bundle of fibers was split from the part at the winding gap, and the inclined-fiber processing was collapsed. Owing to this, a strip-like winding-seam irregularity as shown in FIG. 9B noticeably appeared on the 30000th sheet, and the winding-seam irregularity became further noticeable on the 50000th sheet. The irregularity angle ψ at this time was 32.0°.

In this comparative example, the photoconductor drum 3 is electrically charged by the injection charging method, the part of the photoconductor drum 3, which does not contact the fibers of the first and second roll brushes 21*a* and 21, is not electrically charged at all. Owing to this, the winding-seam irregularity was more likely generated as compared with Comparative Examples 1 to 5.

TABLE 1

| | 1st sheet | 30000th sheet | 50000th sheet |
|---|---|---|---|
| Example 1 | ○ | ○ | ○ |
| Example 2 | ○ | ○ | ○ |
| Example 3 | ○ | ○ | ○ |
| Example 4 | ○ | ○ | ○ |
| Example 5 | ○ | ○ | ○ |
| Comparative Example 1 | ○ | Δ | X |
| Comparative Example 2 | ○ | Δ | X |
| Comparative Example 3 | ○ | Δ | X |
| Comparative Example 4 | ○ | Δ | X |
| Comparative Example 5 | ○ | Δ | X |
| Comparative Example 6 | ○ | X | X |

○: Nothing abnormal
Δ: Winding-seam irregularity is slightly generated with halftone
X: Winding-seam irregularity is noticeably generated with halftone In Examples 1 to 5, the core-bar outer diameter R, the brush outer diameter r, the base-cloth width W, the winding direction, the to-photosensitive member linear-velocity ratio $\alpha$, the angle difference $\phi$, and the inter-nip distance d are adjusted so that the winding gap of the downstream roll brush is not superposed on the non-charge part generated by the winding gap of the upstream roll brush. Accordingly, the generation of the winding-seam irregularity can be restricted.

In Examples 1 to 5, the two roll brushes were used. However, the winding-seam irregularity can be restricted even if three or more roll brushes are used. In this case, it is important to satisfy the above-mentioned conditions and to prevent the regions not electrically charged because of the non-fiber part due to the winding gap from being superposed on each other, for at least the two roll brushes, or preferably all the roll brushes.

Also, in Example 5, the injection charging method is used. However, the photoconductor drum is not limited to be of amorphous silicon. In case of OPC, if an injection layer in which conductive particles are dispersed is provided instead of the surface protection layer, an injection charge can be provided.

With the embodiments, the charging device 2 that performs the charging processing on the rotatable photosensitive member 3 includes the first charging member 21*a* formed by winding the base cloth 31, which serves as the strip-like base material and is provided with the conductive fibers 34, around the outer peripheral surface of the cylindrical or columnar core material 30, the first charging member 21*a* being rotatable while contacting the photosensitive member 3. Also, the charging device 2 includes the second charging member 21*b* formed by winding the strip-like base cloth 31 provided with the fibers 34 around the outer peripheral surface of the cylindrical or columnar core material 30, the second charging member 21*b* being rotatable while contacting the photosensitive member 3 at a position located downstream of the first charging member 21*a* in the rotation direction of the photosensitive member 3. The charging device 2 is formed so that the regions 40*a* and 40*b* on the surface of the photosensitive member 3 are not superposed on each other when the charging processing is performed on the rotating photosensitive member 3 by the rotating first and second charging members 21*a* and 21. That is, the first region 40*a* is a region on the surface of the photosensitive member 3 facing the winding seam 35*a* serving as the seam of the base cloth 31 of the first charging member 21*a* at the contact part Nc1 between the first charging member 21*a* and the photosensitive member 3 in the rotation direction of the photosensitive member 3. Also, the second region 40*b* is a region on the surface of the photosensitive member 3 facing the winding seam 35*b* serving as the seam of the base cloth 31 of the second charging member 21*b* at the contact part Nc2 between the second charging member 21*b* and the photosensitive member 3 in the rotation direction of the photosensitive member 3.

Accordingly, since the winding gap 36*b* serving as the seam of the second roll brush 21*b* is not superposed on the potential irregularity 40*a* generated at the upstream side in the image formation direction, the photosensitive member 3 can be electrically charged without a charge irregularity. Hence, high-quality images can be obtained for a long period. That is, with the embodiments, in the charging device 2 using the roll brush 21, the winding-seam irregularity, in which the surface of the photosensitive member 3 is not electrically charged in accordance with the winding seam of the base cloth 31 of the roll brush 21, can be restricted, and high-quality images can be obtained for a long period.

With the present invention, the generation of the winding-seam irregularity of the roll brush can be restricted for a long period.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A charging device configured to electrically charge a rotatable photosensitive member, comprising:

a first charging member formed by winding a base material, which is provided with conductive fibers in a brush-like form, around an outer peripheral surface of a core material, the first charging member being rotatable while the conductive fibers contact the photosensitive member;

a second charging member formed by winding a base material, which is provided with conductive fibers in a brush-like form, around an outer peripheral surface of a core material, the second charging member being rotatable while the conductive fibers contact the photosensitive member, at a position located downstream of the first charging member in a rotation direction of the photosensitive member; and a driving mechanism configured to rotationally drive the first charging member and the second charging member so that, when the first charging member and the second charging member electrically charge the rotating photosensitive member, a region on a surface of the photosensitive member facing a seam, which is formed by mutually adjacent edges of the base material of the first charging member at a contact part between the first charging member and the photosensitive member, is not superposed on a region on the surface of the photosensitive member facing a seam, which is formed by mutually adjacent edges of the base material of the second charging member at a contact part between the second charging member and the photosensitive member.

2. The charging device according to claim 1, wherein the first charging member and the second charging member are each formed by helically winding the base material having a strip-like shape, around the outer peripheral surface of the core material.

3. The charging device according to claim 2, wherein, when Ra and Rb are outer diameters of the core materials of the first and second charging members, ra and rb are outer diameters of the first and second charging members, Wa and Wb are widths in a short-side direction of the base materials of the first and second charging members, $\alpha$a and $\alpha$b are to-photosensitive member linear-velocity ratios of the first and second charging members, d is a distance between the contact part, which is between the first charging member and the photosensitive member, and a contact part, which is between the second charging member and the photosensitive member, in a moving direction of the photosensitive member, and $\phi$ is an angle defined by a straight line extending from the seam of the second charging member to a rotation center of the second charging member and a straight line extending from the contact part between the second charging member and the photosensitive member to the rotation center of the second charging member in a plane perpendicular to an axial direction of the first and second charging members when the seam of the first charging member faces the photosensitive member, expressions are satisfied as follows:

$$|\alpha a|(Ra/ra)\tan(\sin^{-1} Wa/(\pi Ra))=|\alpha b|(Rb/rb)\tan(\sin^{-1} Wb/(\pi Rb)),$$

and $$d \neq N\pi ra/|\alpha a|+\pi rb\phi/(360|\alpha b|),$$

where N is any integer equal to or larger than 0, and the to-photosensitive member linear-velocity ratios aa and ab are expressed by V2*a*/V1 and V2*b*/V1 when V1 is a linear velocity of the photosensitive member and V2*a* and V2*b* are linear velocities of the first and second charging members, which are plus values if the charging members move in the same direction as a direction of the photosensitive member, or minus values if the charging members move in a reversed direction, at the contact parts with respect to the photosensitive member.

4. The charging device according to claim 1, wherein the first charging member and the second charging member are each formed by winding the base material around the outer peripheral surface of the core material so that the seam is parallel to an axial direction of the core material.

5. An image forming apparatus, comprising:

a rotatable photosensitive member;

a charging device including a first charging member formed by winding a base material, which is provided with conductive fibers in a brush-like form, around an outer peripheral surface of a core material, the first charging member being rotatable while the conductive fibers contact the photosensitive member, and a second charging member formed by winding a base material, which is provided with conductive fibers in a brush-like form, around an outer peripheral surface of a core material, the second charging member being rotatable while the conductive fibers contact the photosensitive member, at a position located downstream of the first charging member in a rotation direction of the photosensitive member, the charging device electrically charging the photosensitive member;

a power supply configured to apply a voltage to the charging device;

an exposure device configured to cause a surface of the photosensitive member electrically charged by the first charging member and the second charging member and hence to form an electrostatic latent image;

a developing device configured to develop the electrostatic latent image formed on the surface of the photosensitive member, by using a toner; and a driving mechanism configured to rotationally drive the first charging member and the second charging member so that, when the first charging member and the second charging member electrically charge the rotating photosensitive member, a region on the surface of the photosensitive member facing a seam, which is formed by mutually adjacent edges of the base material of the first charging member at a contact part between the first charging member and the photosensitive member, is not superposed on a region on the surface of the photosensitive member facing a seam, which is formed by mutually adjacent edges of the base material of the second charging member at a contact part between the second charging member and the photosensitive member.

* * * * *